United States Patent [19]

Slesarenko

[11] Patent Number: 4,861,463

[45] Date of Patent: Aug. 29, 1989

[54] VIBRATORY SCREENING MACHINE

[75] Inventor: Vladimir F. Slesarenko, Leningrad, U.S.S.R.

[73] Assignee: Vsesojuzny Nauchno-Issledovatelsky Institut Mekhanicheskoi Obrabotki Poleznykh Iskopaemykh, Leningrad, U.S.S.R.

[21] Appl. No.: 128,270

[22] Filed: Dec. 3, 1987

[30] Foreign Application Priority Data

Dec. 10, 1986 [SU] U.S.S.R. ..... 4158006

[51] Int. Cl.[4] ..... B07B 1/28

[52] U.S. Cl. ..... 209/315; 209/323; 209/346

[58] Field of Search ..... 209/310, 311, 315, 381, 209/347, 368, 320, 357, 364, 365.5, 323, 346, 348, 349; 198/763, 766, 771; 74/26, 110

[56] References Cited

U.S. PATENT DOCUMENTS

| | | | |
|---|---|---|---|
| 1,082,352 | 12/1913 | Morrow | 209/241 |
| 1,145,316 | 7/1915 | Kelly | 209/316 |
| 1,468,005 | 9/1923 | Coyle et al. | 209/344 |
| 3,225,926 | 12/1965 | Dostatni | 209/315 |
| 3,277,903 | 10/1966 | Ganatsiou | 209/315 X |
| 3,425,553 | 2/1969 | Slovic | 209/315 |

FOREIGN PATENT DOCUMENTS

| | | | |
|---|---|---|---|
| 1239919 | 12/1967 | Fed. Rep. of Germany . | |
| 364180 | 10/1938 | Italy | 74/26 |
| 1189508 | 11/1985 | U.S.S.R. | 209/315 |
| 2159603 | 12/1985 | United Kingdom | 209/315 |

OTHER PUBLICATIONS

G. Erlenstadt, "Sonic Screening Machines-Advances and Recent Results of the Practice" Aufbereitungs-Technik, 1977, pp. 333-336.

*Primary Examiner*—Robert B. Reeves
*Assistant Examiner*—Donald T. Hajec
*Attorney, Agent, or Firm*—Burgess, Ryan & Wayne

[57] ABSTRACT

Disclosed is a vibratory screening machine comprising a frame, a pair of screens with meshes of different size, mounted within the frame one above the other, pushers formed by double-arm levers located in the interscreen space and hinged to a support, and vibrating drives for imparting vibrational movements to the pushers. The arms of each lever are made of different length and make contact with different screens, the longer arms contacting the screen with larger-sized meshes.

3 Claims, 2 Drawing Sheets

VIBRATORY SCREENING MACHINE

FIELD OF THE INVENTION

The proposed invention relates to devices for vibrational sizing of disperse material by screening, and more specifically to vibratory screening machines in which the screening surface can be directly excited.

The proposed invention can be most successfully used in mining, metallurgical, chemical industries, in construction materials industry, and in powder production techniques.

BACKGROUND OF THE INVENTION

At present, it is multiple-deck screening machines that are most widely used in practice, wherein the separation of polydisperse materials according to size is accomplished by letting the material pass through a number of screens with meshes of different sizes, which are placed one beneath the other. In this case, to provide an efficient separation of the material, an individual optimum amplitude of vibration should be assigned to each screen, depending on manufacturing parameters of which classification size is the most important one.

Known in the prior art is a vibratory screening machine of WA series manufactured by "Rhewun" of the Federal Republic of Germany (Aufbereitungs-Technik, Nr. 7, July, 1977, (G. Erlenstadt, "Schallsiebmaschinen-Weiterentwicklung und neue Betriebsergebnisse", p. 333–336), comprising a frame, screens with meshes of different sizes positioned in the frame one above the other, pushers formed by impact levers located beneath the screen, each of the levers being mounted on a supporting shaft and adapted to make contact with the surface of the screen, and electromagnetic vibrating drives. Each electromagnetic vibrating drive is coupled to one supporting shaft for reversible rotation thereof through a given angle. In so doing, the impact lever secured to the shaft transmits vibrations of a particular amplitude from the vibrating drive to the underlying screen.

One disadvantage, however, of this device is its high cost, due to a plurality of expensive electromagnetic vibrating drives, their number increasing with the number of screens in the machine.

Known in the art is a vibratory screening machine (DE, C, 1239919) comprising a frame, at least two screens located in the frame one above the other, pushers formed by double-arm levers placed in the interscreen space, each of them being rigidly secured to a shaft and adapted to make contact with different screens, and a vibrating drive. The vibrating drive is coupled to one of the shafts for reversible rotation thereof through a given angle, while the remaining shafts are joined both to the aforementioned shaft and to one another by means of kinematic transmissions. Each lever type pusher has arms of the same length arranged symmetrically about the shaft axis. Said pushers transmit vibrations of a particular amplitude from the vibrating drive to the screens.

In such a device the vibrations imparted to the screens are of the same amplitude determined by the vibration amplitude of the drive. Such vibrations of the screens fail to provide the required screening effect, since the materials on individual screens are subjected to different processing conditions.

SUMMARY OF THE INVENTION

It is an object of the invenion to provide a vibratory screening machine having an improved screening effect for polydisperse materials.

With this and other objects in view, there is proposed a vibratory screening machine comprising a frame, an upper screen and a lower screen arranged in the frame with an interscreen space between them, the size of the meshes in the upper screen exceeding that in the lower screen. Supports are fixed in the frame, in the interscreen space. Pushers formed by double-arm levers are hinged to the supports, the arms of the levers making contact with different screens. Vibrating drives are provided for imparting vibrational movements to the pushers.

The proposed invention is characterized by the following feature: each lever includes a first arm, a second arm, and a section common to both. The first arms are made of an extended length compared to the second arms, the first arms being in contact with the upper screen and the second arms with the lower screen.

The pushers formed by levers with arms of different length permit the transmission to each screen of vibrations with an amplitude determined by processing properties of the material to be screened on this particular screen, the most important property being the separation size. The longer arm of the pushers contacting the screen with larger-sized meshes transmit vibrations of a higher amplitude. The selection of arm lengths of the pushers according to the processing properties of the material screened allows provision of an amplitude suitable for a given screen, causing an optimum sizing process to be performed on each of the screens with the consequently improved screening effect.

These pushers are preferably formed by V-shaped levers. This configuration of the pushers results in smaller dimensions of the device or, with the outside dimensions left unchanged, it permits an increased carrying capacity of the screen by means of mounting a larger number of pushers, which leads to a greater output of the screening machine.

According to another embodiment of the device, in a vibratory screening machine comprising at least one additional screen, it is preferred that, according to the invention, the ends of the lever arms in adjacent interscreen spaces contacting the same screen be located in opposite relationship to each other.

Such arrangement of the levers in adjacent interscreen spaces avoids the necessity of additional vibrating drives for imparting vibrations to each added screen, ensuring a reliable transmission, through the pushers, of vibrations from the drive to the screens.

The aforementioned objects and advantages of the proposed invention will be more apparent from the following detailed description of its embodiment with referense to the accompanying drawings.

DESCRIPTION OF THE PREFERRED EMBODIMENT OF THE INVENTION

Figure 1:
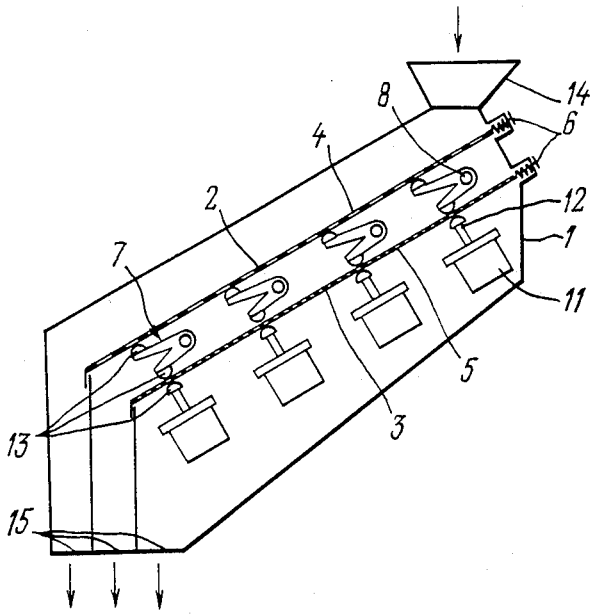
FIG. 1 is a schematic representation of a double-deck vibratory screening machine, according to the invention.

The vibratory screening machine comprises a frame (FIG. 1) in which there are positioned slantwise, one above the other, an upper screen 2 and a lower screen 3. Meshes 4 are provided in the upper screen 2, and meshes 5 in the lower screen 3, the former being of a larger size than the latter. Both of the screens 2 and 3 are provided with tensioning means 6 ensuring the required prestressing for the screens 2 and 3. Pushers formed by double-arm levers 7 are disposed between the screens 2 and 3.

The levers 7 are preferably of a V-shaped profile.

The levers 7 are hinged to a supporting shaft 8. An alternative method of hinging the double-arm levers to the support is, for example, a rigid attachment of the lever to the supporting shaft, which in turn is pivotally mounted in the holder of the frame (not shown in the drawings for the sake of simplicity).

Figure 2:
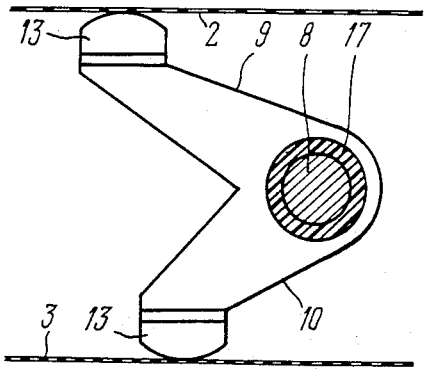
FIG. 2 shows a pusher of the vibratory screening machine.

An arm 9 (FIG. 2) of the pusher 7 is of a greater length than an arm 10 of the pusher 7, the former making contact with the upper screen 2 which has larger-sized meshes 4.

Located beneath the lower screen 3 are vibrating drives 11 with rods 12 interacting, through the screen 3, with the arm 10 of the pushers 7. It is also possible to place the vibrating drives 11 above the upper screen 2 and to have them interact therewith.

The ends of the arms 9 and 10, and of the rods 12, contacting the screens 2 and 3 are provided with protective tips 13 having an elastomeric coating for extending their operating life. If the necessity arises to provide a linear vibrational excitation of the screens 2 and 3, rather than the pointwise excitation, the tips 13 may be replaced by impact elements of an elongated shape (not shown for clarity). A loading bin 14 is mounted on the frame 1 above the top end of the screen 2, and the frame 1 is provided with discharge chutes 15 for discharging the below-screen, intermediate, and above-screen classification products.

Figure 3:
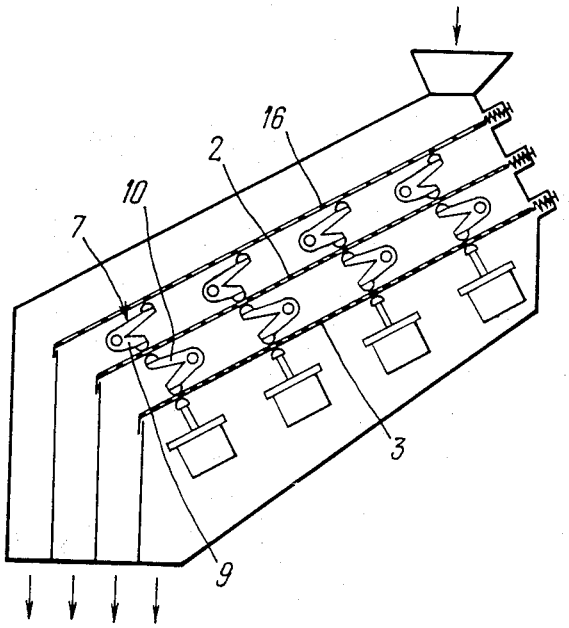
FIG. 3 is a schematic view of a triple-deck vibratory screening machine.

According another embodiment of the invention, in which the screening machine includes at least one additional screen 16 (FIG. 3), the ends of the arms 9 and 10 of the levers 7 located in adjacent inter-screen are in opposite relation to each other.

Other embodiments of the invention involve alternative methods of attachment of the vibrating drives to the pushers, such as a direct attachment of the drives to the shaft with pushers rigidly mounted thereon.

For convenient replacement of the screens 2 and 3, in the process of assembly and disassembly of the screening machine a sleeve 17 is inserted into the pusher 7 (FIG. 2), the sleeve being made of elastomeric material to prevent rotation of the pusher under gravity.

The vibratory screening machine operates in the following way.

With the vibrating drives 11 actuated, the rods 12 impart vibrational movements to the screen 3, which are transmitted through the screen 3, in a direction perpendicular thereto, to the lower arm 10 of the pusher 7, causing the same to rotationally swing about the axis of the supporting shaft 8. The other arm 9 of the pusher 7 transmits vibrations to the screen 2.

The optimum vibration amplitudes of the screens 2 and 3 are known to be determined by manufacturing properties of the material to be screened, which are specified for each individual screen, the most significant of the properties being the separation size. These amplitudes are provided by an appropriate choice of the lengths of the arms 9 and 10 of the levers 7.

The optimum vibration amplitudes of the screens produce the maximum screening effect. If necessary, the variation of the amplitudes is achieved by substitution of the pushers 7 with other lengths of the arms 9 and 10.

The source material is fed through the loading bin 14 to the vibrating screens 2 and 3, is shifted downslope by vibration and separated into three products discharged from the screening machine through the chutes 15.

What is claimed is:

1. A vibratory screening machine comprising a frame;

an upper screen and a lower screen with meshes provided therein, arranged in said frame so that an interscreen space is formed between said screens, the size of said meshes in said upper screen exceeding the size of said meshes in the lower screen, and said upper screen extending in a first plane and said lower screen extending in a second plane;

pushers formed by said double-arm levers, each of them including a first arm, a second arm, and a section common to both arms, said first arms of said lvers being longer than said second arms, said first arms being unattached to and making contact with said upper screen, and said second arms being unattached to and making contact with said lower screen;

supports for mounting said pushers thereon, located in said interscreen space and fixed in said frame, said sections common to both arms being hinged to said supports and vibrating drives in communication with said pushers for imparting vibrational movement thereto such that said pushers impart vibrational movements to the screens in a direction substantially perpendicular to the first and second planes.

2. A vibratory screening machine of claim 1 in which said pushers are of V-shaped configuration.

3. A vibratory screening machine of claim 1 including an additional screen outside of said interscreen space, said additional screen forming an additional interscreen space between one of the upper and lower screens and addition, in which additional pushers are located in said additional interscreen space, said additional pushers having arms and at least one of said arms of each of said pushers in the first-mentioned interscreen space and said additional inter-screen space are in contact with one and the same screen.

* * * * *